US007134935B1

(12) United States Patent
Papetti

(10) Patent No.: US 7,134,935 B1
(45) **Date of Patent: *Nov. 14, 2006**

(54) LUBRICATED RAZOR BLADE EDGE SANITIZER AND SHARPENER

(76) Inventor: Julia Grace Papetti, #7, Tricome Ct., Holmdel, NJ (US) 07733

( * ) Notice: Subject to any disclaimer, the term of this patent is extended or adjusted under 35 U.S.C. 154(b) by 0 days.

This patent is subject to a terminal disclaimer.

(21) Appl. No.: 11/375,904

(22) Filed: Mar. 15, 2006

(51) Int. Cl.
*B24B 49/00* (2006.01)

(52) U.S. Cl. ..... 451/10; 451/11; 451/45; 451/296; 451/450

(58) Field of Classification Search ..... 451/5, 451/6, 10, 11, 45, 59, 168, 296, 355, 523, 451/524, 449, 450
See application file for complete search history.

(56) References Cited

U.S. PATENT DOCUMENTS

| | | | | |
|---|---|---|---|---|
| 1,540,078 A | | 6/1925 | Long | 451/321 |
| 1,588,322 A | | 6/1926 | McAdoo | 335/283 |
| 1,832,539 A | * | 11/1931 | Ezzell | 451/296 |
| 2,289,062 A | * | 7/1942 | Muros | 451/191 |
| 2,458,257 A | | 1/1949 | Donovan | 451/321 |
| 3,854,251 A | | 12/1974 | Paule | 451/321 |
| 3,875,702 A | * | 4/1975 | Yacos | 451/163 |
| 5,036,731 A | | 8/1991 | Fletcher | 76/82 |
| 5,224,302 A | | 7/1993 | Grossi | 451/556 |
| 6,062,970 A | | 5/2000 | Back | 451/556 |
| 6,488,834 B1 | | 12/2002 | Francis | 205/652 |
| 6,506,106 B1 | * | 1/2003 | Fletcher | 451/293 |
| 6,969,299 B1 | * | 11/2005 | Papetti | 451/6 |
| 2005/0101231 A1 | * | 5/2005 | Sekerich | 451/234 |
| 2005/0245175 A1 | * | 11/2005 | Combs | 451/45 |

FOREIGN PATENT DOCUMENTS

EP 0 293 512 B1 4/1991

OTHER PUBLICATIONS http://www.moderngent.com/site/razormatel.php.

* cited by examiner

*Primary Examiner*—Eileen P. Morgan
(74) *Attorney, Agent, or Firm*—Ernest D. Buff & Associates, LLC; Ernest D. Buff; Dave Narasimhan

(57) ABSTRACT

An automatic razor blade sharpener simultaneously sharpens and sanitizes multiple edges of a spring-loaded disposable razor blade cartridge without edge overheating by lubricated gentle contact of the blade edges with a moving rubber or polymeric compliant belt that is motor driven. The disposable razor blade handle is set in a cradle aperture, which is spring loaded against the moving belt. A sanitizing and lubricating liquid is dispersed from a container between the razor blade edges and the moving belt forms a thin liquid layer on the belt surface. The liquid layer is illuminated by transversely located light illuminator and the reflected light is received by a transversely located sensor. Deep grooves in the blade cutting edge reduce this reflection, indicating an overly worn blade. The absence of reflection actuates an LED, informing the user that the thin liquid film has evaporated or spilled out, or that the container lacks a sufficient quantity of sanitizing and lubricating liquid.

20 Claims, 3 Drawing Sheets

LUBRICATED RAZOR BLADE EDGE SANITIZER AND SHARPENER

BACKGROUND OF THE INVENTION

1. Field of the Invention

The present invention relates to a razor blade sharpener; more particularly to a disposable multiple edge razor blade sharpener that sharpens a plurality of blade edges in a cartridge at the same time without frictional heat damage, and sanitizes the cutting edges.

2. Description of the Prior Art

Many patents address issues related to sharpening razor blades and some address sharpening razor blades with multiple cutting blade edges. The disposable razor blades with multiple cutting edges are generally sharpened from only one side, unlike double-edged razor blades wherein the cutting edge is formed by sharpening upper and lower surfaces and the cutting edge is the intersection of these two sharpened surfaces. Vigorous polishing may easily damage sharp, thin blade edges.

U.S. Pat. No. 1,540,078 to Long discloses a razor blade sharpener. A single edged Gillette safety razor blade is sharpened. The safety razor blade is secured to a metal handle and stropped over a pair of corrugated inclined metallic strips attached to a wooden block. Sliding motion sharpens the safety razor blade edge. Stropping or honing of the razor blade edge over corrugated metal manually destroys the edge rather than sharpening it since the single edge safety razor blade is hard. The device does not sharpen a blade edge automatically and has no means to sharpen multiple edge disposable razor blade cartridges.

U.S. Pat. No. 1,588,322 to McAdoo discloses a razor blade sharpener without the use of a strop or hone. A magnetized holder is used to act on the extremely fine sensitive cutting edge of a razor blade and return it to its normal position. The blade edge is not sharpened, but rather the magnetic forces are used to bring the edge back to its normal position. This device can only act on blades which are magnetizable, like the Gillette single edge blue blades. The disclosed a razor blade sharpener cannot accommodate multiple edge blades.

U.S. Pat. No. 2,289,062 to Muros discloses a safety razor receptacle. A frictionally retained double-edged blade is pivotally mounted to a blade holder. Two stropping rollers sharpen the edge of the blade as they are manually rotated by turning a crank handle. This blade-sharpening device is only capable of sharpening double sided blades and not multiple edge blades, and especially not blades which are mounted in a cartridge. Furthermore, the operation of the device is manual, not automatic.

U.S. Pat. No. 2,458,257 to Donovan discloses a safety razor blade sharpener. A double-sided safety razor blade is slid against a substantially flat abrading surface ensuring intimate contact of the entire cutting edge. Such a device is operable for sharpening a double-sided blade, not a multiple edge blade; it is not capable of handling blade cartridges. Moreover, the sharpening operation is manual, not automatic.

U.S. Pat. No. 3,854,251 to Paule discloses a sharpening device for cutting implements such as razor blades. The sharpening device employs a vibrating unit to reciprocate the blade to be sharpened between a series of honing elements, which are spring load biased. The honing cylinders may be removed and rotated to expose fresh honing surface to the blade edge that is being sharpened. This is an automatic honing apparatus for a double-sided blade using cylindrical honing stones and vibratory movement. There is no provision for sharpening a safety razor blade with multiple edges, especially blades which are mounted in a cartridge.

U.S. Pat. No. 3,875,702 to Yacos discloses a blade sharpening mechanism. Two sharpening stones are mounted on a flexible frame which is subjected to reciprocating or vibratory movement by a motor driven cam. When the shaft is rotated in one direction, one edge of the blade is engaged against the stone, while rotating the shaft in the opposite direction engages the opposite edge of the blade against the stone. It is capable of sharpening a double-sided safety razor blade by pressing one edge against a vibrating or reciprocating stone. The opposite side of the same edge is polished when a shaft is rotated to contact the opposite side of the edge against another vibrating or reciprocating stone. This device is incapable of sharpening multiple edge blades, especially blades which are mounted in a cartridge and requires sharpening from one side only.

U.S. Pat. No. 5,036,731 to Fletcher discloses a razor-sharpening device. This razor blade sharpening device includes a sharpening member, a housing for securing the sharpening member therein and mechanism for manually guiding a razor blade in back-and-forth sharpening movement within the housing. The housing has a transverse slot for inserting a head of a razor blade holder, and a longitudinal slot in a top plate thereof for linear movement therein of the handle, which carries the blade holder. The sharpening or honing member is made of a plate of glass secured to the bottom wall of the housing. There are no moving parts within the sharpening device and all sharpening movement is provided by the user moving the handle securing the razor blade. The device requires manual operation whereby the user must slide a razor blade over the hard surface anchored to the bottom of the device. There is no indication that this device can be used for multiple edge cartridge blades.

U.S. Pat. No. 5,224,302 to Grossi discloses a device for re-conditioning cutting elements of disposable double-blade shavers. The device for re-conditioning the cutting elements of disposable double-blade shavers includes a supporting structure having guides for directing manual sharpening of the blades. The device also includes abrasive elastic material portions fixed to the structure. Re-conditioning of the blades is obtained by providing friction between the blades and the sharpening surfaces. The device is for re-conditioning cutting elements of disposable double-blade shavers. The double edge blade is manually sharpened by the two abrasive elements attached to the T shaped device. This device does not automatically sharpen multiple edged safety razor blades.

U.S. Pat. No. 6,062,970 to Back (hereinafter, the "'970 patent") discloses a stropping device of a blade for safety razors. The stropping device consists of a main body and an adhesive sheet attached on the back surface of the main body. A guide groove part is longitudinally formed on a front portion of the main body, while a protrusion is integrally and horizontally formed on a top portion of the main body. A stropping plate member, produced from a leather material such as a natural or synthetic leather or suede, is attached on the bottom surface of the guide groove part by an adhesive means. The multiple edge razor is moved manually by the user against a stopping leather in order to sharpen a razor blade. No disclosure is contained by the '970 patent concerning an automatic razor blade sharpening device.

U.S. Pat. No. 6,488,834 to Francis discloses a blade re-sharpener and method. The razor blade sharpener utilizes the principles of an electrochemical cell. The blade forms an anode (−) and a cathodic plate provided in close proximity to the razor edge to be sharpened. The blade tip edge is sharpened electrochemically to provide a fresh, or "as new" razor blade. The blade sharpener has additional uses for sharpening, for example, kitchen knifes and surgical blades. The current source is an external source of current, such as a solar cell, battery or D.C. power supply. The cathodic plate is stainless steel or a conductive plastic, or nickel-plated copper or solid nickel. The electrolyte is a weak solution of sulphuric acid, which will also function as a descaler. The sterilizing substance could be sodium hypochloride. In fact, most ionic solutions will work as the electrolyte equally as well as sulphuric acid. By using a saturated saline solution for the ionic conductor, a safer cell is provided. Two cathodic plates could be provided to sharpen a blade, such as a kitchen knife on two sides thereof. Preferably, the current source would be controlled to switch from one plate to the other. In this device, the electrolytic cell has ionic conducting solutions such as weak sulfuric acid, saturated saline solution, etc., and the blade being sharpened is made as an anode. Passage of electrical current dissolves the anode, presumably sharpening the blade. Since stainless steel razor blades, which are almost universally used, have a protective oxide layer, the passage of current is expected to produce pits in the razor blade rather than sharpening it uniformly. In addition, electrical contact has to be made with the razor blade, which may be difficult in a blade cartridge.

U.S. Pat. No. 6,506,106 to Fletcher discloses an automated razor-sharpening device. This apparatus for sharpening a razor blade comprises a motor actuated sharpening member mounted in a housing with a slot for receiving the razor head and a cradle assembly for engaging the distal end of the razor handle to hold the razor head in the slot. A carriage assembly holds the sharpening member opposite to the slot with its sharpening surface engaging the cutting edge of a razor blade secured in the razor head. A drive assembly, driven by a motor operated by a timing circuit, causes a repetitive movement of the sharpening surface for a predetermined period of time. The electric drive system of the sharpener comprises a small electric motor and a reduction gear assembly. The reduction gear assembly drives a cam assembly arranged to slidingly oscillate back and forth a carriage on which is mounted a rectangular strip or slide of mildly abrasive material. This mildly abrasive material may be a hard vitreous material such as, for example, glass, porcelain, or a ceramic. Testing of the motorized sharpening device indicates that the useful life of typical hand-held razors, such as a GILLETTE, SCHICK and BIC, may be extended from about 10 to about 150 shaves, or about 1500%. In this automated razor-sharpening device, the dual edged blade is made to engage with an abrasive slide, which is rigid and oscillated by a cam and motor drive. Since this overall arrangement is rigid, any slight misalignment in the positioning of the razor blade results in complete loss of razor edge. This limitation becomes even more serious when two or more razor blades in a disposable razor cartridge are located side by side and contact the oscillating abrasive slide. Moreover, the disclosure does not provide a way to determine when the blade edges are adequately sharpened.

U.S. Pat. No. 6,969,299 to Papetti discloses an automatic razor blade sharpener. Multiple edges of a spring-loaded disposable razor blade cartridge are sharpened simultaneously by gently contacting the blade edges with a moving rubber or polymeric compliant belt that is motor driven. The disposable razor blade handle is set in a cradle aperture, which is spring loaded against the moving belt. A timer terminates the blade sharpening operation, indicated by a green LED. A liquid is dispersed on the moving belt forming a thin liquid layer on the belt surface. The liquid is illuminated by transversely located light illumination, and the reflected light is received by a transversely located sensor. When the blade contacts the thin liquid layer, deep grooves in the blade cutting edge reduce this reflection. The reduced reflection indicates that the blade is too worn to be sharpened, whereupon a red LED light is actuated. Absence of reflection indicates that the thin liquid film has evaporated or spilled out. The liquid used is not a lubricant and the blade edge being polished is not prevented from overheating. Heat generated frictionally during polishing of the edges can damage the sharp cutting edges of the blade. Worn blades also carry skin debris, which attract microbial organisms. These microbial organisms can infect the user when the polished multiple edged blade is used.

Foreign Patent No. EP 393512 to Lepar discloses a device for honing razor blades, with the emphasis being placed upon twin-bladed razors. It was found that detritus tends to accumulate and eventually clog the space between the blades and this contributes to the rapid degradation of the blade and generally to an unhygienic state of affairs. The device for honing razor blades aims to provide a means of enhancing the blade life, and at the same time brings a welcome improvement in blade hygiene. A header chamber receives the water and there is an opening in a common wall between the shroud and the chamber for passage of the water to the blade(s) of the mounted razor. The principle of operation of the device is essentially similar to that which will enable the constant dripping of water to wear away a stone. In shaving, the blades are always drawn across the skin in a uniform direction and this tends to cause the very keen edge of the blades to be slowly bent back until the cutting angle of the blades has been so altered that the blade now feels blunt. By passing a stream of water over the blades in the opposite direction, and particularly when under reasonable pressure, the very keen edge is gently bent back to the correct angle. Repeated use of the apparatus of the invention will keep this cutting edge properly aligned and honed for a considerable period of time. This patented device cleans accumulated debris between blades by use of high-pressure water. The rapid movement of water is said to deform the blade edge in a direction that is opposed to shaving thereby straightening out any blade edge deformation caused by shaving. Since very high flow rates are needed to apply adequate force, it is unlikely that the blade edges are brought back to their original geometry.

Reference ModernGent.com at http://www.moderngent-.com/site/razormatel.php on the Internet discloses a shaving kit addition. By placing the razors blade edge on the RazorMate's scientifically positioned force field the edge is straightened by magnetostriction after each shave. The blade is also shielded from rusting and pitting between shaves. The RazorMate increases the life of any disposable razor blade. It even improves new blades by straightening and reducing the number of irregularities that occur in the factory. RazorMate takes up very little space being about the same size as a TV remote. Permanent ceramic magnets mean there is no maintenance needed. Just place your razor on the RazorMate and leave it there till you next shave. RazorMate makes your blade last significantly longer saving you money and cutting down on waste so it is also eco-friendly. The device uses ceramic permanent magnets, which has a low 'energy product' and therefore precludes application of strong magnetic fields. It is therefore unlikely that any razor edge is straightened by the device.

There remains a need in the art for a reliable, disposable multiple edge razor blade sharpening device that automatically sharpens razor blade multiple edges without frictionally generated heat damage, and at the same time sanitizes the razor blade's multiple edges and signals the user when the sharpening operation is complete.

SUMMARY OF THE INVENTION

The present invention provides an automatic razor blade sharpening and sanitizing device especially suited to sharpen razor blade cartridges with multiple blades wherein the cutting edges are disposed parallel to each other. During manufacture, these blades are sharpened from one side only. This procedure is unlike the process used for double-edged razor blades. The latter are sharpened from both sides, with the result that the cutting edge of the double-sided razor blade is at the intersection of the polished surfaces. The cartridge-type razor blades used in this invention are concurrently sanitized and sharpened at the same time from one side only. Each blade's cutting edge is at the intersection of the polished surface and the flat under surface of the blade. The sharpening operation is carried out with the blade edges constantly bathed in an aqueous sanitizing and lubricating medium, thereby limiting the heat generated by friction between the blade edge and the polishing belt. The aqueous sanitizing and lubricating medium also carries a water soluble sanitizing agent which kills microbes such as bacteria, fungi or viruses carried by the worn edge that is being sharpened by the automatic razor blade sharpening device.

The automatic razor blade sharpening device comprises a central unit, which encloses the razor blade mechanism for safety reasons. The central unit comprises an aperture for receiving a razor blade cartridge. It is held against the razor blade sharpening mechanism with a gentle pressure. The razor blade sharpening mechanism comprises a compliant belt manufactured from rubber or polymeric material, which is embedded with 5 to 25 micron hard particles. Since these hard particles are embedded in the belt, they do not separate easily from the belt. The belt is stretched between two rollers and is moved by a motor drive. The motor may be activated by turning on a switch. Alternatively, the switch may be connected to the spring mechanism that holds the razor blade cartridge, so that the motor is turned on when the cartridge is inserted into the razor blade sharpening device. An aqueous sanitizing and lubricating liquid is contained in a bottle attached to the side of the central unit. The sanitizing and lubricating liquid is pumped and delivered at the location where the razor blade edges contact the moving rubber or polymeric belt. The impinging aqueous sanitizing and lubricating liquid immediately forms a boundary layer, since the aqueous lubricating sanitizing liquid wets the multiple blade edges and the belt surface of the blade at the same time. This rapidly moving liquid boundary layer extracts heat generated by the polishing action, limiting the temperature rise of the sharp blade edges, and preventing deterioration of the hardness and cutting properties of the razor blade edge. The sanitizing agent contained in the aqueous lubricating liquid destroys all the germs contained in the skin debris attached to the edges of a previously used worn multiple blade razor blade cartridge.

Both the polishing belt and the holding springs are compliant, and as a result, the razor blade cartridge is very gently placed against the moving belt having hard particles embedded therein. If this contact were to be rigid, the blade would not be polished uniformly, especially when multiple razor blades are present, and as a result the blade cutting edge would be completely ruined. The hard particles in the moving rubber or polymeric belt are chosen from diamond, silicon carbide or alumina, and with particle diameters ranging from 5 to 25 microns. These small sized particles gently hone or polish the cutting surface of the blades in the cartridge, providing a keen cutting edge. Since the particles are firmly embedded in the belt, they are not readily removed during the polishing operation.

The razor blade sharpener has two springs attached to a cradle, which has an aperture. When the handle of a multiple blade disposable razor cartridge is placed in this aperture, the spring tension pulls the multiple razor blade cutting surfaces against the compliant belt. The motor driving the belt may be switched on by a switch. Alternatively, the spring tension may be used to activate the motor. In either case, the pump for dispensing the sanitizing and lubricating liquid is activated before belt movement is initiated. The motor may be shut off after a preset period of time and illuminating a green 'ready' light indicating to the user that the polishing operation is complete.

In a second embodiment, a sanitizing and lubricating liquid is squirted onto the rubber or polymeric belt impregnated with hard particles when the belt is moving. A thin liquid film coating forms on the belt surface. This coating is optically viewed to assess the quality of cutting edge being generated. A light source is used to direct light transverse to the belt movement direction at a shallow angle to the belt surface. Reflected light from the sanitizing and lubricating liquid film is captured by a sensor that is also mounted opposite to the light source and transverse to the belt movement direction for receiving this reflected light. A baseline measurement is taken before the razor blade edge contacts the thin sanitizing and lubricating liquid film. When a razor blade with multiple blades contacts this sanitizing and lubricating liquid film, the reflection will be reduced if streaks are formed. Such streaks are produced in response to deep irregularities, such as grooves, in the cutting edge. These deep grooves cannot be polished by the blade-sharpening device. The light-receiving sensor detects this condition, and the red LED light is actuated, indicating to the user that the razor blade is too worn to be sharpened.

When a razor blade is sharpened, the thin sanitizing and lubricating liquid film remains on the belt as a lubricant. If the liquid film evaporates or is spilled off or the bottle containing sanitizing and lubricating liquid becomes empty, the light reflection from the thin liquid film is lost and the blade sharpening process is terminated by the blade-sharpening device. The red LED light is then actuated to inform the user that the liquid film has been lost and the bottle containing the sanitizing and lubricating liquid should be refilled. Under normal conditions, the blade sharpening process is terminated by the preset timer before the reflection from the thin liquid film is lost.

BRIEF DESCRIPTION OF THE DRAWINGS

The invention will be more fully understood and further advantages will become apparent when reference is had to the following detailed description of the preferred embodiments of the invention and the accompanying drawings, in which.

DETAILED DESCRIPTION OF THE INVENTION

Figure 1:
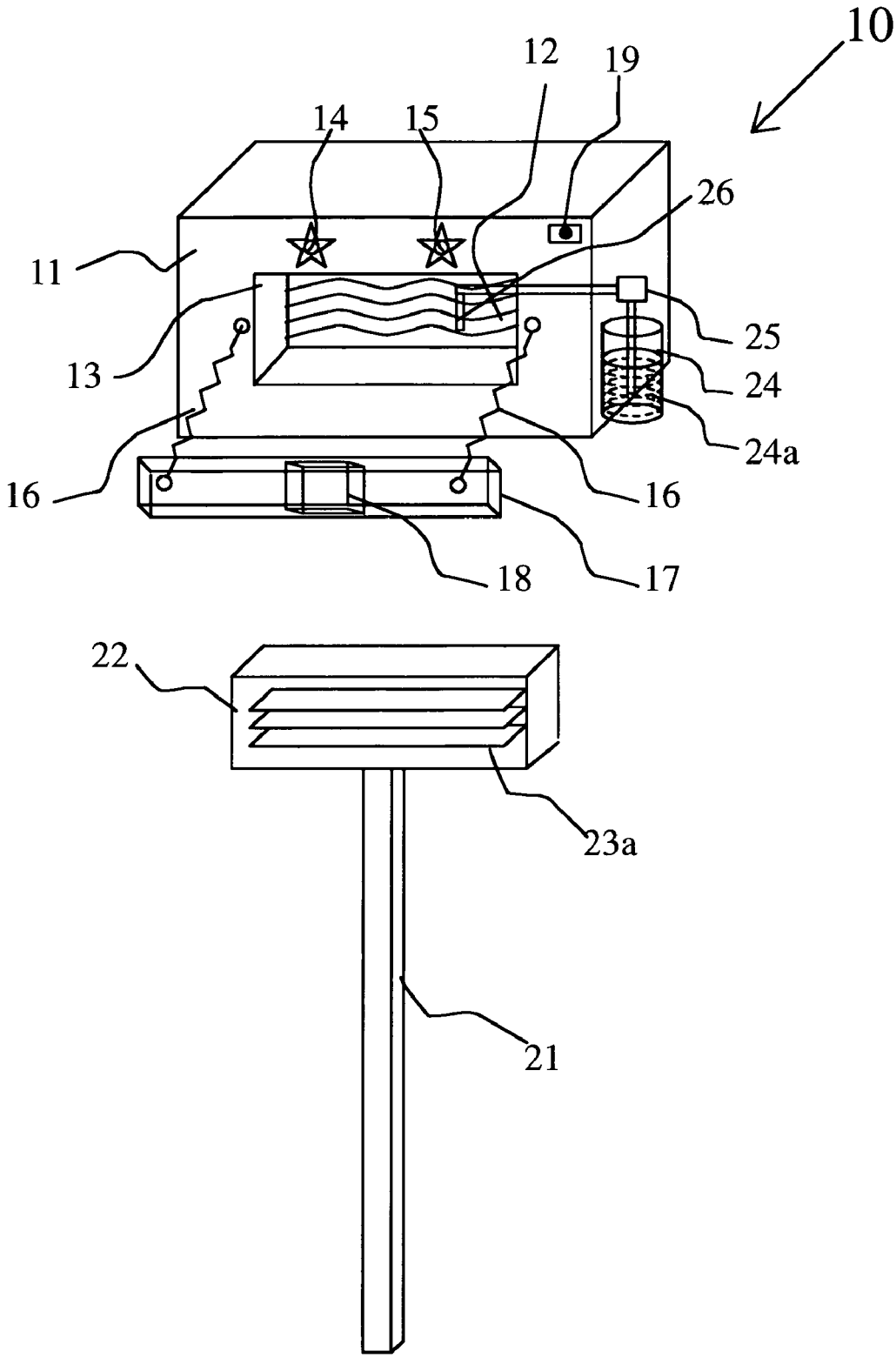
FIG. 1 is a diagrammatic representation of the razor blade sharpener and accompanying razor.

The present invention provides an automatic razor blade sharpening device that is particularly well suited to sharpen razor blade cartridges having multiple blades. In such razor blade cartridge arrangements, the cutting edges of the blades are disposed parallel to each other, and the sharpening action is aided by a constant supply of lubricant and sanitizing liquid flow. The cartridge type razor blades used in this invention are sharpened from one side only by the razor blades coming in gentle contact with a compliant moving belt having hard particles embedded therein. These hard particles are typically 5 to 25 microns in diameter. The gentle contact of the razor blade with the compliant moving belt is assured by a spring loading mechanism that pushes the razor blade against the compliant moving belt. A hard contact of the cutting edge results in non-uniform sharpening of the cutting edge, especially when multiple razor blades are present, resulting in damaged cutting edges.

Generally stated, the invention comprises a razor blade sharpening system conveniently designed to allow the re-sharpening of razor blades as they become dull, thereby promoting a longer service life and a more comfortable shave. These dull blades accumulate skin debris, which becomes a storehouse containing microbes and germs. The re-sharpening system prevents the spread of these microbes and germs by using a constant flow of sanitizing and lubricating liquid at locations where the blade edges contact the sharpening moving belt. The system of the present invention is suited for sharpening razor blades which have a plurality of cutting edges, each of which is disposed parallel to the others. Due of the longer service lives of razor blades sharpened in accordance with the invention, frequent purchases of replacement razor blade cartridges are avoided, and an economic benefit is realized by the user. A cleaner, more comfortable shave is regularly achieved, in a shorter time and at less expense.

The Razor Blade Sharpener comprises a central unit operable for attachment onto the wall of a bathroom. The central unit includes an internal razor blade sharpening mechanism powered either by a battery or through an electrical connection to a standard wall socket. The central unit is capable of sharpening razor blades by the rapid movement of a soft leather or polymeric belt impregnated with 5 to 25 micron size hard abrasive particles. It includes an aperture within which the blade sharpening mechanism is contained. The razor blade cartridge is positioned compliantly within the aperture to allow compliant contact with the moving belt, thereby contacting the entire cutting edges of the multiple blades of a cartridge. Since the contact between the razor blade and the moving belt is gentle, the cutting edge is honed or dressed by the movement of 5 to 25 micron sized particles embedded in the belt, thereby providing a keen edge. Together, the aperture and blade sharpener are capable of receiving various sized razor blade cartridge heads with razor blades, including those from leading manufacturers such as Gillette, Schick, and the like. Optionally, the aperture and blade sharpener combination is specifically designed with dimensions that are operable for use only with a specific brand and type of razor, such as the GILLETTE MACH 3® razor. Alternatively, special razor blades may be used, which may be less expensive and more suitable for re-sharpening than blades currently on the market.

The central unit further includes a bottle for containing the sanitizing and lubricating liquid, which is dispensed to the contacting region between the blade edges and the moving sharpening belt. The dispensing operation may be conveniently done by a pump driven by an electric motor powered by the same power source that powers the movement of the sharpening belt. It is preferred that the sanitizing and lubricating liquid dispensing pump be turned on before initiating the movement of the sharpening belt. The cutting edges of these blades are extremely thin and sharp. Dry honing of these cutting edges results in rapid increase in the temperature of the cutting edge. These hardened blade cutting edges lose hardness and strength properties as a function of temperature. In addition, the reaction with ambient air results in oxidation of the cutting edge, producing oxides of iron and other alloying elements of the blade, which are extremely brittle, resulting in rapid loss of the cutting edge. It is therefore imperative that the cutting edges be maintained at a low temperature, and more preferably as close as possible to the ambient temperature. The flow of the sanitizing and lubricating liquid delivered by the pump rapidly takes away any heat generated by friction during the sharpening operation. The sanitizing and lubricating liquid also kills any germs and microbes present at the edge of the cutting edge attached to skin debris and the like. At the termination of the sharpening operation, the cutting edges of the blades are sharp, and any microbes or germs present at the edges are substantially removed, preventing the possibility of infection.

A number of lubricants and sanitizing agents may be employed with the sanitizing and lubricating liquid. A preferred carrier for the sanitizing and lubricating compounds is water, since it easily rinsed and the blade, after sharpening, may even be used immediately, without any rinsing operation. While oil based lubricants are readily available, they are immiscible in water and therefore are not recommended for use with aqueous liquid. Water soluble anti-microbial soaps are readily available from commercial sources such as Dial liquid soap and the like. These disinfectant liquid soaps have a surfactant which functions as a lubricant and one or more anti-microbial agents. Typical surfactants include ethoxylated alkylphenol, an ethoxylated fatty alcohol, a propoxylated fatty alcohol, an alkyl polyglucoside, a polyethylene glycol ether of sorbitol, an ethylene oxide-propylene oxide block copolymer, an ethoxylated ester of a fatty (C.sub.8–C.sub.14) acid, a condensation product of ethylene oxide with a long chain amine or amide. These surfactants reduce the surface tension of the aqueous sanitizing and lubricant liquid against the cutting edges and the moving sharpening belt resulting in a thin continuous liquid layer between the cutting edges and the moving belt. Typical anti-microbial agents include triclosan, bisguanidines (e.g., chlorhexidine digluconate), diphenyl compounds, benzyl alcohols, trihalocarbanilides, quaternary ammonium compounds, ethoxylated phenols, and phenolic compounds, such as halo-substituted phenolic compounds, like PCMX (i.e., p-chloro-m-xylenol) and triclosan (i.e., 2,4,4'-trichloro-2'hydroxy-diphenylether). Present-day antimicrobial compositions based on such antibacterial agents exhibit a wide range of antibacterial activity, ranging from low to high, depending on the microorganism to be controlled and the particular antibacterial composition.

The disinfectant liquid soap is mixed with water in a ratio of 1 part of disinfectant soap to 20 to 1000 parts of water depending on the degree of disinfectant needed to form a sanitizing and lubricating liquid. The sanitizing and lubricating liquid is filled in the bottle attached to the central unit. The sanitizing and lubricating is pumped to the cutting edge sharpening location and is disposed of through a drain provided in the central unit.

The unit further includes an internal sensor, which measures the contact between the cutting edge of the razor blade and the moving belt impregnated with 5 to 25 micron particles. Water or another type of suitable lubricating liquid, optionally containing a fine abrasive particle suspension, may be dripped on the moving belt to form a thin uniform liquid layer. A light and light-receiving sensor are transversely mounted to obtain a baseline value of the reflection prior to insertion of the blade within the device. When a multiple edge safety blade is inserted, the liquid layer on the belt is disturbed. If the cutting edge is reasonably free from damage, the output from the light-receiving sensor is comparable to the baseline value. However, if the blade edge is nicked or has deep grooves, a series of lines are generated in the thin liquid film and the light receiving sensor receives reduced light intensity, thereby indicating that the blade edge is worn and is unfit for processing in the razor blade sharpening apparatus. The belt movement may be turned off when the reflection from the thin film disappears, indicating that the thin liquid film has either evaporated or spilled over, based on a fixed honing time period.

The light receiving sensor triggers one of two different colored LED indicator bulbs, depending on the status of the razor blades. If the sensor determines that the blade is too worn and cannot be re-sharpened, as indicated by reduced reflected light intensity, a red LED light is actuated, to thereby inform the user that the blade has reached the end of its service life and should therefore be discarded, and the belt movement turned off. If the sensor determines that the blade can be sharpened, as indicated by reflection intensity comparable to the baseline, the sharpening operation proceeds. At this stage, the belt is completely parallel to the razor blade edge with no undulations on the edge being sharpened. At the completion of the preset time sharpening period, the belt movement is turned off and a green LED indicator light is illuminated to inform the user that the razor is ready for use. If the liquid film is lost during the sharpening operation due to evaporation or spillage, the reflection is no longer present and the red LED light is lit, indicating to the user the condition of the thin liquid film. The central unit preferably has a durable and attractive outer shell, made from a suitable polymeric material. In another embodiment, the unit further comprises means for rotating the razor blades from their standard angled orientation to a straight position, in order to allow the sharpening process to be more efficient.

The invention is suitable for home use and safely sharpens razor blades of different construction, having two cutting blades, three cutting blades or four cutting blades. This sharpening process provides for a faster, more comfortable shave—shave after shave—and reduces the cost of buying new cartridges. The Razor Blade Sharpener first determines if a blade can be effectively sharpened, thereby preventing the premature disposal of razor blade cartridges which are still capable of being adequately sharpened.

Referring to FIG. 1, there is shown a razor blade sharpener and accompanying razor. The razor blade sharpener, shown generally at 10, comprises a central unit 11 operable for attachment onto the wall of a bathroom. The unit 11 includes an internal razor blade sharpening mechanism 12, detailed in FIG. 3, below, which is powered either by a battery or through an electrical connection to a standard wall socket (not shown). The unit includes a bottle 24 for containing a sanitizing and lubrication liquid 24*a* pumped by an electrically operated pump 25 and delivers the sanitizing and lubricating liquid to the sharpening mechanism 12 through spout 26. The unit includes an aperture 13 for inserting a razor blade cartridge head 22, typically located on the upper end of a razor handle 21. The razor blade sharpening mechanism 12 is positioned completely within the aperture 13 to prevent accidental injury to the user or a child. The central unit 11 has two springs 16 attached to the main body carrying a cradle 17 for receiving the handle 21 of the disposable razor cartridge. The handle 21 of the disposable razor cartridge is inserted in an aperture 18 in the cradle 17. The motor drive for the razor blade sharpener is activated by switch 19 or optionally by the springs 16 by activating a switch when a razor blade is inserted for sharpening. Together, the aperture 13 and blade sharpener 12 are capable of receiving various sized razor blade cartridge heads 22 with razor blades 23*a*, including those from leading manufacturers such as Gillette, Schick, and the like. Optionally, the aperture 13 and blade sharpener 12 combination is specifically designed with dimensions that are operable for use only with a specific brand and type of razor, such as the GILLETTE MACH 3® razor. Alternatively, special razor blades may be used, which may be less expensive and more suitable for re-sharpening than blades currently on the market.

Figure 3:
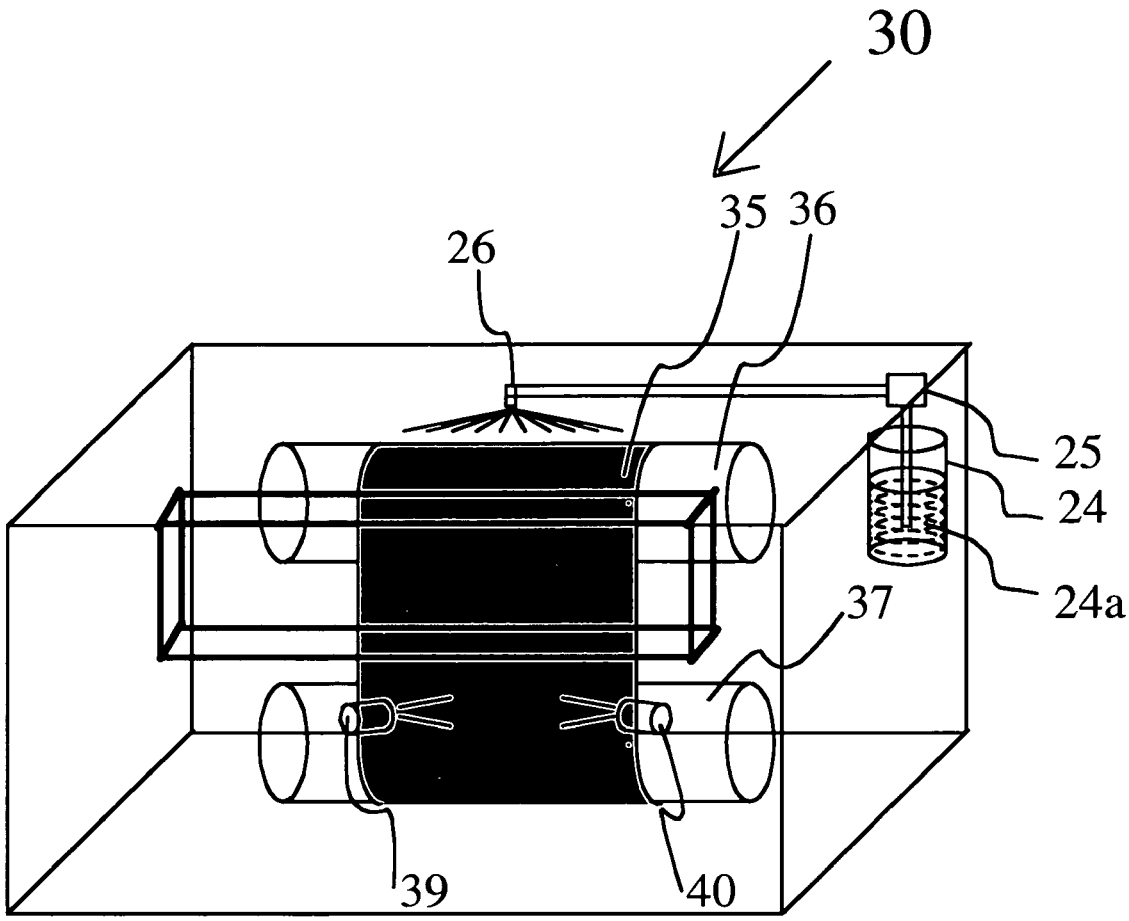
FIG. 3 is a diagrammatic representation of the details of the interior construction of the razor blade sharpening mechanism and the optional sensor arrangement.

Optionally, the unit 11 further includes an internal sensor, as shown in FIG. 3, below, which informs the user as to the status of the razor blade 23*a* that is being serviced. The sensor triggers one of two different colored LED indicator bulbs 14 and 15, respectively, depending on the status of the razor blades 23*a*. If the sensor determines that the blade 23*a* can be sharpened, it will activate the internal blade sharpener 12; when the blade 23*a* has been completely re-sharpened, a green LED indicator 14 will illuminate, thereby informing the user that the razor 23*a* is ready for use. On the other hand, if the blade 23*a* has been sufficiently worn such that it can no longer be adequately sharpened by the unit 11, then the sensor triggers a red LED indicator 15, thereby informing the user that the blade 23*a* has reached the end of its service life and should therefore be discarded. The unit 11 preferably has a durable and attractive outer shell, made from a suitable polymeric material. In another embodiment, the unit further comprises means for rotating the razor blades 23*a* from their standard angled orientation 23*a* to a straight position, in order to allow the sharpening process to be more efficient.

Figure 2:
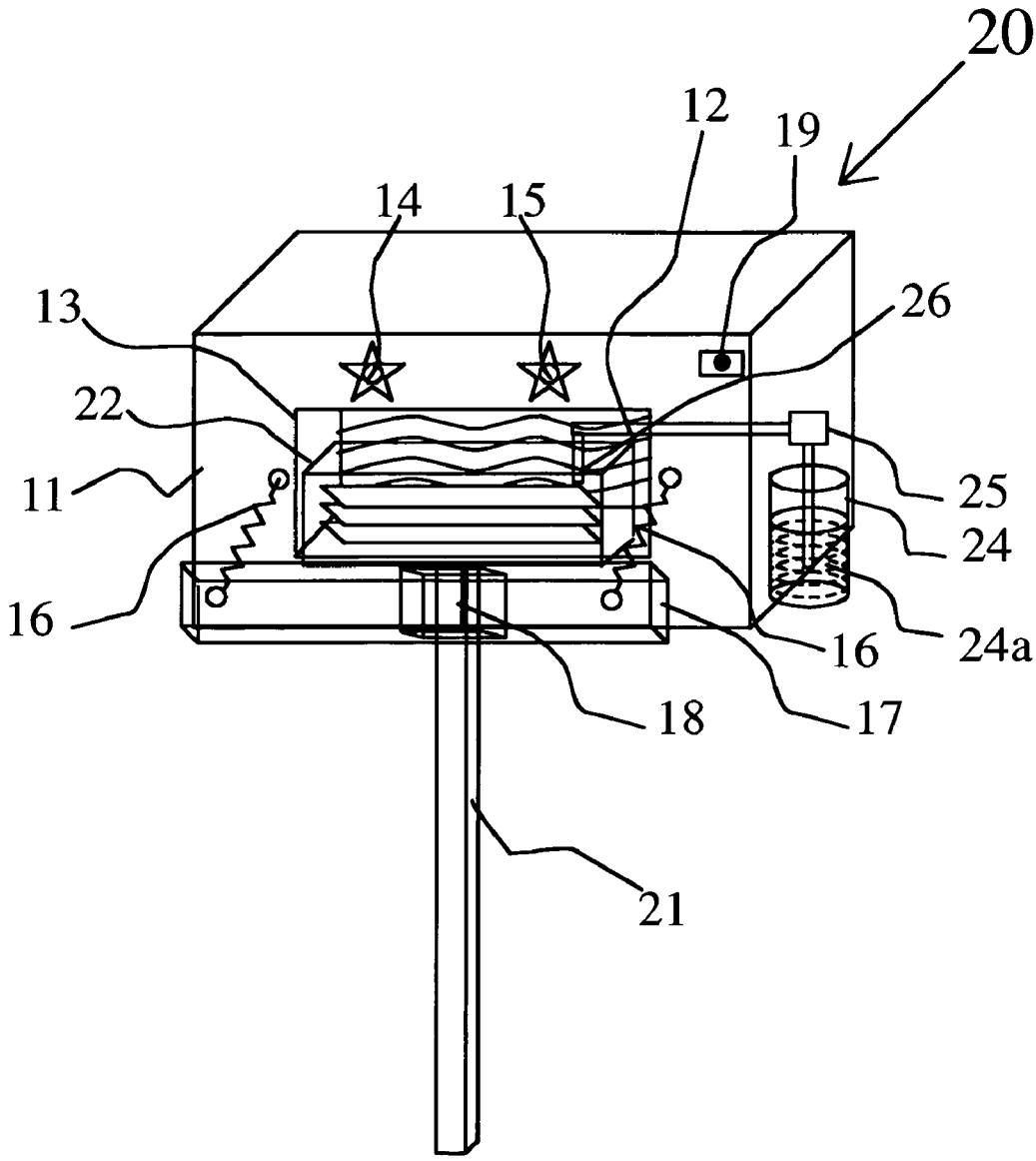
FIG. 2 is a diagrammatic representation of the razor blade sharpener and the razor cartridge in the sharpening position.

Referring to FIG. 2, there is shown at 20 a razor blade handle 21 placed in the aperture 18 of the cradle 17 with the springs 16 gently placing the cartridge 22 with multiple razor blade edges against the sharpening mechanism 12.

Referring to FIG. 3, there is shown at 30, the details of the interior construction of the razor blade sharpening mechanism and the optional sensor arrangement. A belt 35 is made from rubber or polymeric material impregnated with 5 to 25 micron particles. The belt is stretched between two rollers 36 and 37 and is driven by a motor (not shown). The belt is springy and makes gentle contact with the edge of the razor blade, even when multiple blades are present. The belt surface is lubricated by sanitizing and lubricating liquid 24 a contained in bottle 24, pumped by pump 25 delivered at spout 26. A transversely mounted light 39 and a light-receiving sensor 40 determine the integrity of the liquid film on the belt. Reflection of light from the thin liquid film decreases when a razor blade with a substantially deteriorated cutting edge contacts the moving belt, thereby indicating that the cutting edge of the razor blade is worn and unsuitable for sharpening. The sharpening operation may be terminated based on either a pre-selected time or on an absence of reflection from the thin liquid film, indicating that the thin liquid film has evaporated or has spilled away from the belt.

The key components of the razor blade sharpener include, in combination, the features set forth below:

1. an automatic razor blade sharpening machine comprising a central unit;
2. the central unit being provided with an aperture for receiving multiple blade disposable razor blade cartridges attachable to a holder;
3. the central unit comprising an attached bottle containing sanitizing and lubricating liquid;
4. the central unit comprising a motor driven belt sharpening mechanism;
5. the belt sharpening mechanism comprising a compliant rubber or polymeric belt impregnated with 5 to 25 micron hard particles suited for gently contacting and honing or sharpening the cutting edge of a razor blade, particularly the cutting edges of a cartridge having multiple blades;
6. a spring mechanism for gently holding the cartridge within the aperture so that the blade edges contact the moving belt;
7. the sanitizing and lubricating liquid being pumped from the bottle attached to the central unit by a pump and sprayed to coat the moving belt surface and cutting edges of the blade with a thin liquid film;
8. optionally, a light source transversely mounted to the movement of the belt, illuminating the thin liquid film;
9. a sensor transversely mounted to receive the reflected light from the thin liquid layer on the belt;
10. the sensor determining the quality of the cutting edge by measuring the reflection as compared to a baseline value that is established prior to blade contact;
11. the sensor determining that the razor blade is too worn and is unsuitable for polishing/sharpening operation by poor reflection from the thin liquid film;
12. the sensor determining that the razor blade sharpening operation is to be terminated by absence of reflection from the thin liquid film due to evaporation, or spillage, or exhaustion of sanitizing and lubricating liquid contained in the bottle; and
13. termination of the razor blade sharpening process based on a pre-selected time period.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. An automatic razor blade sharpening device, comprising:

a. a central unit enclosing a razor blade sharpening mechanism;

b. said razor blade sharpening mechanism comprising a motor driven compliant moving belt, said moving belt being composed of a rubber or polymeric material and impregnated with hard particles having a size ranging from 5 to 25 microns and suited for gently contacting and honing or sharpening a razor blade, said razor blade having a cutting edge and housed in a cartridge having multiple razor blades;

c. said razor blade sharpening mechanism comprising a bottle or container attached to said central unit and containing a sanitizing and lubricating liquid, which is pumped by an electrically powered pump and delivered to the contacting region between said razor blade cutting edges and said moving belt;

d. said cartridge being a disposable razor blade cartridge and having an attachable holder;

e. said central unit being provided with an aperture adapted for receiving said cartridge; and f. a spring mechanism adaptable for applying an applied spring tension for gently holding said cartridge within said aperture so that said cutting edges of said razor blades contact said moving belt;

whereby said cutting edges of said razor blades located in said cartridge are polished and sanitized automatically without overheating due to lubrication by gentle contact between said moving belt and said cutting edges of said razor blades housed in said cartridge, and said cartridge is held in place by said applied spring tension.

2. An automatic razor blade sharpening device as recited by claim 1, wherein said sanitizing and lubricating liquid is a mixture of anti-microbial liquid soap and water.

3. An automatic razor blade sharpening device as recited by claim 1, wherein said sanitizing and lubricating liquid is a mixture of anti-microbial liquid soap and water in the range of 1:20 to 1:1000 on a volume basis.

4. An automatic razor blade sharpening device as recited by claim 1, wherein said hard particles are diamond abrasives.

5. An automatic razor blade sharpening device as recited by claim 1, wherein said hard particles are silicon carbide abrasives.

6. An automatic razor blade sharpening device as recited by claim 1, wherein said hard particles are alumina abrasives.

7. An automatic razor blade sharpening device as recited by claim 1, wherein said sanitizing and lubricating liquid comprises finely dispersed abrasive particles.

8. An automatic razor blade sharpening device as recited by claim 1, wherein said pump is activated by a switch connected to said spring mechanism when said razor blades' said cutting edges contact said moving belt.

9. An automatic razor blade sharpening device as recited by claim 1, wherein said motor is activated by a switch connected to said spring mechanism when said cutting edges of said razor blades contact said moving belt.

10. An automatic razor blade sharpening device as recited by claim 1, wherein said pump and motor are turned off by a timer circuit.

11. An automatic razor blade sharpening device, comprising:

a. a central unit enclosing a razor blade sharpening mechanism;

b. said razor blade sharpening mechanism comprising a motor driven compliant moving belt, said moving belt being composed of a rubber or polymeric material and impregnated with hard particles having a size ranging from 5 to 25 microns and suited for gently contacting and honing or sharpening a razor blade, said razor blade having a cutting edge and housed in a cartridge having multiple razor blades;

c. said razor blade sharpening mechanism comprising a bottle or container attached to said central unit and containing sanitizing and lubricating liquid pumped by an electrically powered pump and delivered to the contacting region between said razor blade cutting edges and said moving belt, forming a thin liquid film;

d. said cartridge being a disposable razor blade cartridge and having an attachable holder;

e. said central unit being provided with an aperture adapted for receiving said cartridge;

f. a spring mechanism adaptable for applying an applied spring tension for gently holding said cartridge within said aperture so that said cutting edges of said razor blades contact said moving belt to begin a sharpening process, said moving belt having a surface;

g. a light source transversely mounted to said moving belt illuminating said thin liquid film on said moving belt's surface and reflecting light therefrom;

h. a sensor transversely mounted to said moving belt adapted to receive said reflecting light from said thin liquid film on said moving belt's surface;

i. said sensor being adapted for determining the quality of said cutting edge by measuring said reflecting light as compared to a baseline value that is established prior to contact between said cutting edges of said razor blades and said moving belt; and j. said razor blade sharpening mechanism being adapted for determining the unsuitability of said cartridge for said sharpening process based on a lack of complete contact of said cutting edges with said thin liquid film, resulting in a condition that decreases the intensity of said reflected light; and k. said razor blade sharpening mechanism being adapted for determining the termination of said sharpening process based on a decreased intensity of said reflecting light from said thin liquid film, indicating that said thin liquid film has evaporated or spilled out;

whereby said cutting edges of said razor blades located in said cartridge are polished and sanitized automatically without overheating due to lubrication by gentle contact between said moving belt and said cutting edges of said razor blades housed in said cartridge, said cartridge being held in place by said applied spring tension.

12. An automatic razor blade sharpening device as recited by claim 11, wherein said sanitizing and lubricating liquid is a mixture of anti-microbial liquid soap and water.

13. An automatic razor blade sharpening device as recited by claim 11, wherein said sanitizing and lubricating liquid is a mixture of anti-microbial liquid soap and water in the range of 1:20 to 1:1000 on a volume basis.

14. An automatic razor blade sharpening device as recited by claim 11, wherein said hard particles are diamond abrasives.

15. An automatic razor blade sharpening device as recited by claim 11, wherein said hard particles are silicon carbide abrasives.

16. An automatic razor blade sharpening device as recited by claim 11, wherein said hard particles are alumina abrasives.

17. An automatic razor blade sharpening device as recited by claim 11, wherein said sanitizing and lubricating liquid comprises finely dispersed abrasive particles.

18. An automatic razor blade sharpening device as recited by claim 11, wherein said pump is activated by a switch connected to said spring mechanism when said razor blades' said cutting edges contact said moving belt.

19. An automatic razor blade sharpening device as recited by claim 11, wherein said motor is activated by a switch connected to said spring mechanism when said cutting edges of said razor blades contact said moving belt.

20. An automatic razor blade sharpening device as recited by claim 11, wherein said pump and motor are turned off by a timer circuit prior to loss of sensor reflection signal.

* * * * *